US011136682B2

(12) United States Patent
Von Kaenel et al.

(10) Patent No.: US 11,136,682 B2
(45) Date of Patent: Oct. 5, 2021

(54) CATHODE CURRENT COLLECTOR FOR A HALL-HEROULT CELL

(71) Applicant: NOVALUM SA, Venthhone (CH)

(72) Inventors: Rene Von Kaenel, Venthone (CH); Gualtiero Spinetti, Salo (IT)

(73) Assignee: NOVALUM SA, Venthone (CH)

( * ) Notice: Subject to any disclaimer, the term of this patent is extended or adjusted under 35 U.S.C. 154(b) by 414 days.

(21) Appl. No.: 15/527,397

(22) PCT Filed: Jun. 8, 2015

(86) PCT No.: PCT/IB2015/054325

§ 371 (c)(1),
(2) Date: May 17, 2017

(87) PCT Pub. No.: WO2016/079605

PCT Pub. Date: May 26, 2016

(65) Prior Publication Data

US 2017/0321338 A1 Nov. 9, 2017

(30) Foreign Application Priority Data

Nov. 18, 2014 (CH) ..... 01778/14

(51) Int. Cl.
*C25C 3/16* (2006.01)
*C25C 7/02* (2006.01)

(52) U.S. Cl.
CPC ..... *C25C 3/16* (2013.01); *C25C 7/025* (2013.01)

(58) Field of Classification Search
CPC ..... C25C 3/06–3/24; C25C 7/025
See application file for complete search history.

(56) References Cited

U.S. PATENT DOCUMENTS

| | | | | |
|---|---|---|---|---|
| 4,624,766 | A * | 11/1986 | Boxall | C04B 35/5611 204/294 |
| 4,795,540 | A | 1/1989 | Townsend | |
| 5,976,333 | A | 11/1999 | Pate | |
| 6,231,745 | B1 | 5/2001 | Homley et al. | |
| 2003/0173214 | A1 * | 9/2003 | Juric | C25C 3/16 204/290.01 |
| 2006/0151333 | A1 | 7/2006 | Banek | |
| 2008/0135417 | A1 * | 6/2008 | Allano | C25C 3/08 205/560 |

(Continued)

FOREIGN PATENT DOCUMENTS

| | | |
|---|---|---|
| EP | 2133446 | 12/2009 |
| WO | 0127353 | 4/2001 |

(Continued)

*Primary Examiner* — Ciel P Contreras
(74) *Attorney, Agent, or Firm* — Sturm & Fix LLC

(57) ABSTRACT

The invention relates to an electrolytic cell (1) for the production of aluminium (2) including collector bars structure modifications (13,14,15,16) under the cathode (4), namely a copper collector bar held in a U-shaped profile or directly embedded into the cathode. This leads to an optimized current distribution in the liquid aluminium metal (2) and/or inside the carbon cathode allowing for operating the cell at lower voltage. The lower voltage results from either a lower anode to cathode distance (ACD), and/or to lower voltage drop inside the carbon cathode from liquid metal to the end of the collector bar.

13 Claims, 12 Drawing Sheets

(56) References Cited

U.S. PATENT DOCUMENTS

| | | | | |
|---|---|---|---|---|
| 2010/0258434 | A1 | 10/2010 | Bayer et al. | |
| 2010/0294635 | A1* | 11/2010 | Despinasse | C25C 3/16<br>204/230.2 |
| 2013/0062217 | A1* | 3/2013 | Beeler | C25C 7/06<br>205/560 |

FOREIGN PATENT DOCUMENTS

| | | |
|---|---|---|
| WO | 0163014 | 8/2001 |
| WO | 0242525 | 5/2002 |
| WO | 2004031452 | 4/2004 |
| WO | 2005098093 | 10/2005 |
| WO | 2007118510 | 10/2007 |
| WO | 2008062318 | 5/2008 |
| WO | 2011148347 | 12/2011 |

* cited by examiner

CATHODE CURRENT COLLECTOR FOR A HALL-HEROULT CELL

FIELD OF INVENTION

The invention relates to the production of aluminium using the Hall-Héroult process; in particular to the optimization of the collector bars for the decrease of energy consumption, maximization of the current efficiency and increase of cell productivity.

BACKGROUND OF THE INVENTION

Aluminium is produced by the Hall-Héroult process, by electrolysis of alumina dissolved in cryolite based electrolytes at temperature up to 1000° C. A typical Hall-Héroult cell is composed of a steel shell, an insulating lining of refractory materials and a carbon cathode holding the liquid metal. The cathode is composed of a number of cathode blocks in which collector bars are embedded at their bottom to extract the current flowing through the cell.

A number of patent publications have proposed different approaches for minimizing the voltage drop between the liquid metal to the end of the collector bars. WO2008/062318 proposes the use of a high conductive material in complement to the existing steel collector bar and gives reference to WO 02/42525, WO 01/63014, WO 01/27353, WO 2004/031452 and WO 2005/098093 that disclose solutions using copper inserts inside collector steel bars. U.S. Pat. No. 4,795,540 splits the cathode in sections as well as the collector bars. WO2001/27353 and WO2001/063014 use high conductive materials inside the collector bars. US200610151333 covers the use of different electrical conductivities in the collector bars. WO 2007/118510 proposes to increase the section of the collector bar when moving towards the center of the cell for changing the current distribution at the surface of the cathode. U.S. Pat. Nos. 5,976,333 and 6,231,745 present the use of a copper insert inside the steel collector bar. EP 2 133 446 A1 describes cathode block arrangements to modify the surface geometry of the cathode in order to stabilize the waves at the surface of the metal pad and hence to minimize the ACD (anode to cathode distance).

WO 2011/148347 describes a carbon cathode of an aluminium production cell that comprises highly electrically conductive inserts sealed in enclosures within the carbon cathode. These inserts alter the conductivity of the cathode body but do not participate in current collection and extraction by the collector bars.

The electrical conductivity of molten cryolite is very low, typically 220 $\Omega^{-1}$ $m^{-1}$ and the ACD cannot be decreased much due to the formation of magneto-hydrodynamic instabilities leading to waves at the metal-bath (metal—cryolite electrolyte) interface. The existence of waves leads to a loss of current efficiency of the process and does not allow decreasing the energy consumption under a critical value. On average in the aluminium industry, the current density is such that the voltage drop in the ACD is a minimum at 0.3 V/cm. As the ACD is 3 to 5 cm, the voltage drop in the ACD is typically 1.0 V to 1.5 V. The magnetic field inside the liquid metal is the result of the currents flowing in the external busbars and the internal currents. The internal local current density inside the liquid metal is mostly defined by the cathode geometry and its local electrical conductivity. The magnetic field and current density produce the Lorentz force field which itself generates the metal surface contour, the metal velocity field and defines the basic environment for the magneto-hydrodynamic cell stability. The cell stability can be expressed as the ability of lowering the ACD without generating unstable waves at the surface of the metal pad. The level of stability depends on the current density and induction magnetic fields but also on the shape of the liquid metal pool. The shape of the pool depends on the surface of the cathode and the ledge shape. The Prior Art solutions respond to a given level to the needed magneto-hydrodynamic status to satisfy good cell stability (low ACD) but the solutions using copper inserts are very expensive and often need sophisticated machining processes.

SUMMARY OF THE INVENTION

The invention relates to a cathode current collector for a carbon cathode of a Hall-Héroult cell for the production of aluminium, of the type where the cathode current collector comprises a central section that incorporates at least one bar of a highly-electrically-conductive metal which in use is located under the carbon cathode, the highly-electrically conductive metal having an electrical conductivity greater than that of steel, According to the invention, the highly electrically conductive connector bar comprises a central part located under a central part of the carbon cathode, usually directly located into a cathode slot or through-hole or using a U-shaped profile as support, this central part of the highly electrically conductive connector bar having at least its upper outer surface in direct electrical contact with the carbon cathode or in contact with the carbon cathode through an electrically conductive interface formed by an electrically conductive glue and/or an electrically conductive flexible foil or sheet applied over the surface of the highly electrically conductive connector bar. The highly electrically conductive connector bar comprises one or two outer parts located adjacent to and on one side or on both sides of said central part and a terminal end part or parts extending outwardly from said outer part(s). Moreover, these terminal end part(s) of the highly electrically conductive collector bar is/are electrically connected in series each to a steel conductor bar of greater cross-sectional area than the highly electrically conductive connector bar, said steel conductor bar(s) extending outwardly for connection to an external current supply busbar.

The highly conductive bar can be embedded into a cathode slot or through-hole with or without a U-shaped beam. However, electrical contact can be achieved over the whole embedded area: notably over the top and sides of the highly conductive bar.

Advantageously, the highly electrically conductive metal is selected from copper, aluminium, silver and alloys thereof, preferably copper or a copper alloy.

The surface of the upper part and optionally the sides of the highly electrically conductive metal can be roughened or provided with recesses such as grooves or projections such as fins to enhance contact with the carbon cathode.

When there is a conductive interface between the highly electrically conductive metal and the carbon cathode, such conductive interface can be selected from a metal cloth, mesh or foam, preferably of copper, a copper alloy, nickel or a nickel alloy, or a graphite foil or fabric, or a conductive layer of glue, or a combination thereof. Advantageously the conductive interface comprises a carbon-based electrically conductive glue obtainable by mixing a solid carbon-containing component with a liquid component of a 2-component hardenable glue.

Depending on the cell design, the sides and optionally the bottom of the highly electrically conductive metal bar can directly or indirectly contact ramming paste or refractory bricks in contact with the carbon cathode.

The highly electrically conductive metal bar can be machined with at least one slot or provided with another space, the slot or space being arranged to compensate for thermal expansion of the bar in the cathode by allowing inward expansion of the highly electrically conductive metal into the space provided by the slot(s).

The terminal end parts of the highly electrically conductive metal bar are preferably electrically connected in series to the steel conductor bar forming a transition joint wherein the highly electrically conductive metal bar and the steel conductor bar overlap one another partially and are secured together by welding, by electrically-conductive glue and/or by means for applying a mechanical pressure such as a clamp to achieve a press fit, or a joint secured by thermal expansion. Alternatively, the secured end parts are threaded together. The steel bars forming the transition joint extend outwardly for connection to a busbar network external of the cell, the outwardly-extending end sections of the steel bars having an increased cross-section to reduce voltage drop and assure thermal balance of the cell.

The cathode carbon can electrically contact the open upper outer surface of the highly electrically conductive metal as a result of the weight of the carbon cathode on the highly electrically conductive metal, and by controlled thermal expansion of the highly electrically conductive metal.

The aforementioned outer part(s) of the highly electrically conductive connector bar typically extend under or through an electrically conductive part of the cell bottom, in which case these outer parts of the highly electrically conductive connector bar are electrically insulated from the electrically conductive part of the cell bottom, in particular from side parts of the carbon cathode or ramming paste. Some sections of the highly electrically conductive metal bar are conveniently insulated from the electrically conductive part of the cell bottom by being encased in an insulator, in particular by being encased in one or more sheets of insulating material such as alumina wrapped around said outer part(s) or in a layer of electrically insulating glue or cement or any insulating material capable to withstand up to 1200° C.

In particular embodiments, the bar of the highly electrically conductive metal in the central section of the cathode current collector is held in a U-shaped profile made of a material that retains its strength at the temperatures in a Hall-Héroult cell cathode. Such U-shaped profile can have a bottom under said bar and on which the bar rests, optionally at least one upstanding fin, and side sections that extend on the sides and are spaced apart from or contact the sides of the highly conductive bar. Said highly conductive bar has at least a; upper part and optionally also side parts left free by the U-shaped profile to enable the highly electrically conductive metal to contact the carbon cathode directly or via a conductive interface. The open upper part and preferably also the sides of the highly electrically conductive metal make contact with the carbon cathode directly or via a conductive interface. The U-shaped profile is typically made of a metal such as steel, or of concrete or a ceramic.

The invention also concerns a Hall-Héroult cell for the production of aluminium fitted with a cathode current collector assembly as set out above.

Further Explanations of the Invention

The bar of the highly electrically conductive metal in the central section of the cathode current collector is in direct electrical contact to the carbon cathode or can be glued to the carbon cathode. It can for example be embedded in a groove or a hole in which it can either be glued or fixed by flexible foil or sheet applied over the surface of the highly electrically conductive connector bar. The glue is typically an electrically-conductive carbon-based two component glue.

The highly electrically conductive connector bar comprises outer parts located outside the carbon cathode to connect the highly conductive connector to a conventional steel bar (transition joint) to extract the current outside the cell.

Depending on cathode designs, the highly electrically conductive bar can be arranged as a single bar or as multiple bars in parallel spaced apart by a gap allowing for thermal expansion.

In one embodiment, parts of the cathode collector bar which are located adjacent to and outside its central section that is supported by the U-shaped profile, are electrically insulated so as to be electrically insulated from electrically-conductive components of the cathode (in particular from side parts of the carbon cathode or ramming paste), i.e. when the current collector is installed in a cell.

The highly-electrically-conductive metal has a conductivity greater than that of steel (which was used in prior art cells in the form of a tubular sheath that enclosed the highly-electrically-conductive metal such as copper) and is preferably selected from copper, aluminium, silver and alloys thereof between these metals and possibly with other alloying metals. The highly-electrically-conductive metal is preferably made of copper or a copper alloy.

As mentioned, advantageously, the surface of the open upper free part and the sides of the highly-electrically-conductive metal is roughened for enhanced contact with a carbon cathode. For example, it can be roughened by a machining operation. A typical surface roughness is defined by the average distance from peak to bottom of the roughness profile (cross section of surface). A roughness value from 0.2 mm to 4 mm (or higher) can be used. The rough surface can be obtained with a grinding tool (for lower values) or by a mechanical operation such as machining, embossing, engraving or knurling. Roughening of the surface can be combined with fins, ribs or grooves to increase mechanical retention.

When there is a U-shaped profile, the upper free parts of the highly-electrically-conductive metal can be flat and flush with the open top of a U-shaped profile, or it can protrude from the central part and/or from the top of the U-shaped profile so as to have a protruding upper parts and sides of any shape (notably rounded or rectangular or finned to improve electrical contact area and mechanical retention) in contact directly with the carbon cathode, or through a conductive interface.

The bar embedded into the cathode bottom, with or without a U-shaped profile or beam or other support, is made for example of copper until the outside lateral front face of the cathode block. From this position on, the copper bar is electrically connected in series to a transition joint. The transition joint is the final end piece of the cathode bar. It is used to exit the cell frame and acts as transition joint between the copper bar inside the cell and the bus bars outside the cell frame. The transition joint enables the new concept to be implemented on existing cells without any modification to the cell frame and busbars. Each cell technology may have a different type of transition joint to comply with existing design of the bus bars external to the cell.

Thus the central section of the highly conductive cathode current collector bars is extended by end sections (transition joints) that extend outwardly for connection to a current supply external of the cell. These outwardly-extending end sections, made of steel, have an increased cross-section to reduce the temperature of the end sections, for example to reduce their temperature down to about +200° C. compared to the temperature outside the cell.

The end of the collector bar can thus be connected to the-external busbars of the cell by transition joints. These transition joints can be secured to the highly electrical conductive bar by mechanical pressure, by a weld, by thermal expansion, by mechanical lock, by press fitting, by threading together or a combination thereof. This transition joint can be shaped in such a way that the connecting position of the external flex to an existing busbar remains unchanged, avoiding any modification to the existing shell and to the connecting system to the busbars.

In one embodiment of the inventive cathode current collector assembly, the sides and bottom part of the highly conductive collector bar and/or of a U-shaped profile may contact ramming paste that is in contact with the carbon cathode. However, the ramming paste should not extend above the contact surface of the highly electrically conductive metal.

As mentioned, to control the forces applied to the sides of the cathode slot, the thermal expansion of the highly conductive collector bar embedded into the cathode slot can be controlled by the machining of one or more slots inside the highly conductive collector bar. The gap of these slots closes when reaching the operating temperature. Another way to obtain an expansion slot is by spacing two separate highly conductive collector bars.

Using cathode current collector bars according the invention, increases the conductivity of the carbon cathode enabling the useful height of the cathode block to be increased by from 10% to 30% depending on the original cathode design and the design of the upper contact profile of the highly conductive metal of the new collector bar. By increasing the height of the cathode block, the useful lifetime of the cathode and hence the cell can be increased accordingly.

Using cathode current collector bars according the invention also leads to an optimized current distribution in the liquid metal and/or inside the carbon cathode allowing for operating the cell at lower voltage. The lower voltage results from either a lower anode to cathode distance (ACD), and/or to lower voltage drop inside the carbon cathode from liquid metal to the end of the collector bar.

Instead of using a U profile, the bar can be seated in a hole drilled into the cathode. In that case the high conductive material will be pushed into the hole together with glue. The surface of the high conductive material can be grooved (knurling) so that the contact surface is increased and the grip of the glue as well. In this embodiment, the bar of the highly electrically conductive metal at least in the central section of the cathode is contained in a through-hole in the carbon cathode whereby the bar of highly conductive metal is supported on the underlying part of the carbon cathode and is surrounded by and preferably in direct electrical contact with the surface of the through hole in the carbon cathode.

As discussed above, control of thermal expansion relative to the carbon cathode can be achieved by machining one or more slots into the highly conductive bar or by using two or more spaced bars.

Detailed Explanation of the Invention

The invention is based on the insight, through a thorough study of the collector bars design and its impact on cell magneto-hydrodynamic stability, that there is a possibility of using a better and cheaper technique for the implementation of a high conductive material as collector bars (copper or other) by embedding the conductive bar into a recessed matching seat under the cathode, preferably in direct contact with the carbon cathode, over a specific distance. Mechanical retention and containment may be achieved by using a U-shaped profile to contain the bar from underneath. Mechanical retention can also be achieved by inserting the bar of highly conductive metal into a through-hole in the cathode.

The invention is based on the observation that the cell life is limited by chemical and mechanical erosion which is mainly driven by the current density pattern in the cathode. In order to increase the cathode thickness, and therefore the cell life, the inventive collector bars are simply placed under the cathode flat surface or fit into a recessed matching seat under the cathode such that contact between the carbon cathode and the highly electrically conductive collector bars is realized by the weight of the carbon cathode or by mechanical precision fitting over the upper contact profile line of the collector bar that can be horizontal flat, rounded, elliptical, finned or in general any shape from flat to convex.

To better secure the contact and the position of the conductive bar relative to the cathode over time, a U-shaped profile can be arranged to mechanically hook to lateral positioning slots machined in the cathode seat. The contact between the copper or other highly-electrically conductive collector bar and the carbon cathode can be improved by using an "interface material" placed on top of the high conductive material placed in the U-shaped profile. The interface material can be a metallic foam, such as nickel foam or copper foam and/or structured surfaces penetrating the carbon block such as a metallic mesh or a conductive layer of glue or a graphite foil or fabric or a combination of some of the above "interface materials". These interface materials also have the function of compensating the different thermal expansions of the highly conductive metal relative to the carbon cathode.

In order to assure an optimum current density in the cathode and inside the liquid metal, allowing for increasing the current in the cell, the section of the high conductive metal is computed and depends on the carbon cathode electrical conductivity, the cathode dimension and even the anodes positions in the cell. Outside the central area, the collector bars should be insulated over a specific distance and chosen intervals on the outgoing side of the current to assure a smooth current density at the cathode surface and almost no horizontal current in the liquid metal.

Moreover, in order to decrease the contact resistance between the collector bar and the carbon cathode, a bed of ramming paste can be used on the lower sides of highly conductive current collector and optionally of a U-shaped profile.

The invention also concerns a Hall-Héroult cell for the production of aluminium retrofitted with the inventive cathode current collector or with the inventive cathode current collector assembly.

BRIEF DESCRIPTION OF THE DRAWINGS

The invention will be further described by way of example with reference to the accompanying drawings, in which.

DETAILED DESCRIPTION

Figure 1:
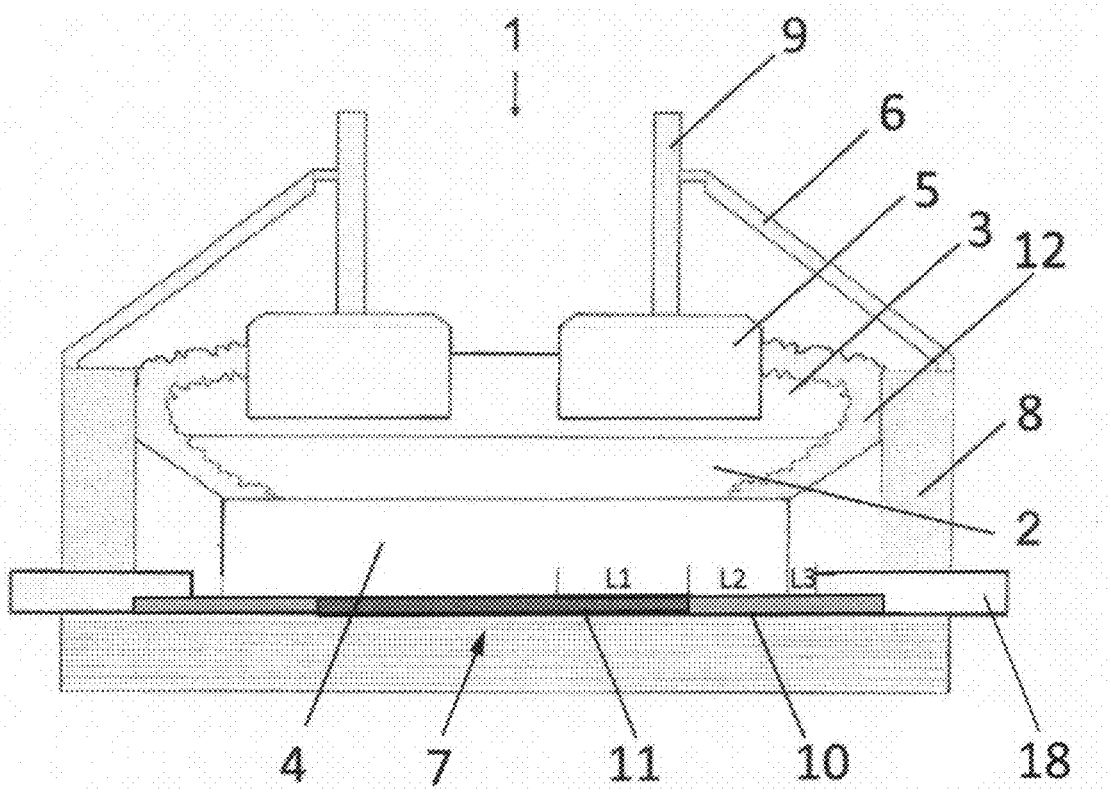
FIG. 1 is a schematic cross-section through a Hall-Héroult cell equipped with a collector bar according to the invention.

FIG. 1 schematically shows a Hall-Heroult aluminium-production cell 1 comprising a carbon cathode cell bottom 4, a pool 2 of liquid cathodic aluminium on the carbon cathode cell bottom 4, a fluoride—i.e. cryolite-based molten electrolyte 3, containing dissolved alumina on top of the aluminium pool 2, and a plurality of anodes 5 suspended in the electrolyte 3. Also shown is the cell cover 6, cathode current collector bars 7 according to the invention that lead into the carbon cell bottom 4 from outside the cell container 8 and anode suspension rods 9. As can be seen, the collector bar 7 is divided in zones. Zone 10 is insulated electrically and zone 11 is composed of layers as shown in FIG. 2, FIG. 3, FIG. 5 or FIG. 6. Molten electrolyte 3 is contained in a crust 12 of frozen electrolyte. Steel bars 18 connected in electrical series to the ends of the collector bars 7 protrude outside the cell 1 for connection to external current supplies.

Zone 10 of the collector bar is for example electrically insulated by being wrapped in a sheet of alumina or by being encased in electrically insulating glue or cement.

Figure 2:
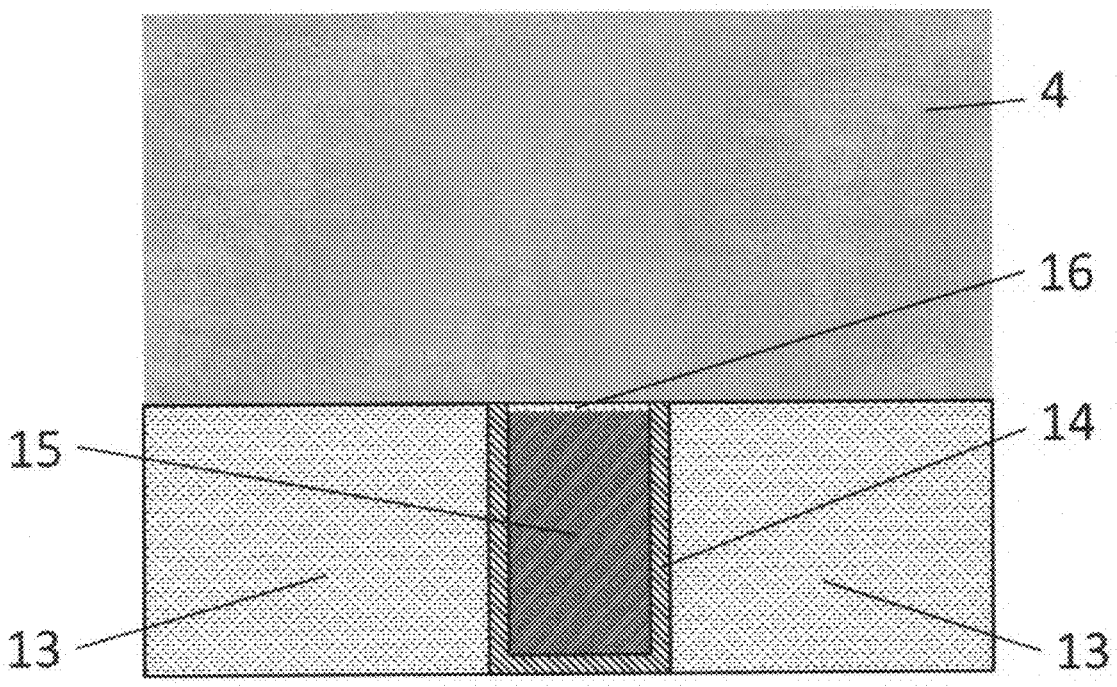
FIG. 2 is a cross section through a first embodiment of collector bar showing a U-shaped profile.

FIG. 2 shows a U-shaped profile 14 made of any type of temperature-resistant conductive or insulating material for example steel and the high electrically conductive material 15 such as copper inside the U-shaped profile 14, forming together the collector bar. As shown, the collector bar is optionally surrounded by a coke bed (i.e. of ramming paste) 13 to decrease the electrical resistance towards the carbon cathode. The free top surface 16 of the high conductive material can be made rough to minimize the electrical contact resistance. In one variation, the sides of the U-shaped profile do not extend to the top of the highly electrically conductive material and in another variation the sides of the U-shaped profile are wider than and spaced apart from the highly electrically conductive material.

Figure 3:
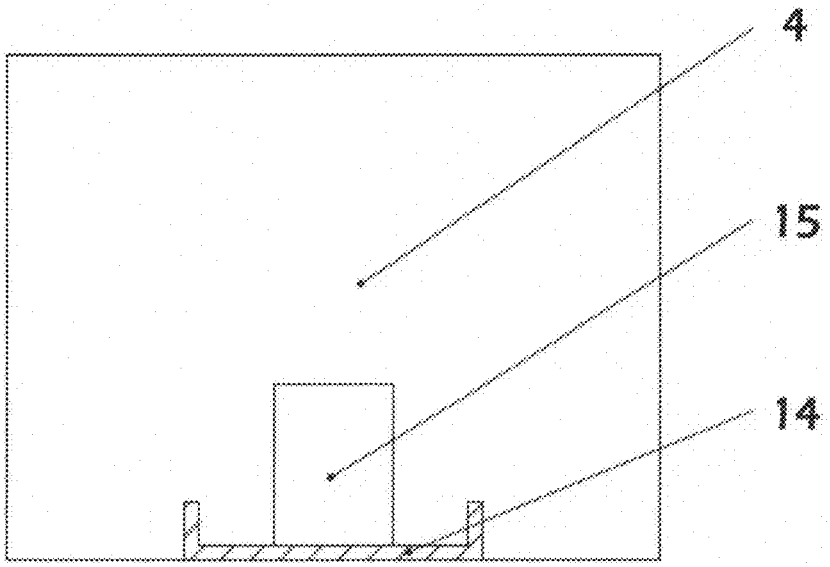
FIG. 3 is a cross section through a second embodiment of collector bar showing another U-shaped profile.

FIG. 3 shows a U-shaped profile 14 made of any type of temperature-resistant conductive or insulating material for example steel and high conductive material 15 such as copper, forming together the collector bar in the case of using the "embedded" collector bar inside the carbon cathode 4. In this embodiment, contrary to FIG. 2 where the top of the copper/metal 15 is flush with the open top of the U-shaped profile 14, here the copper/metal 15 is separated from the two lateral sides of the U-shaped profile thereby increasing the direct electrical contact surface to the carbon cathode 4 on three sides. The lower side of the copper/metal 15 rests on the flat bottom of the U-shaped profile 14 as mechanical support.

Figure 4:
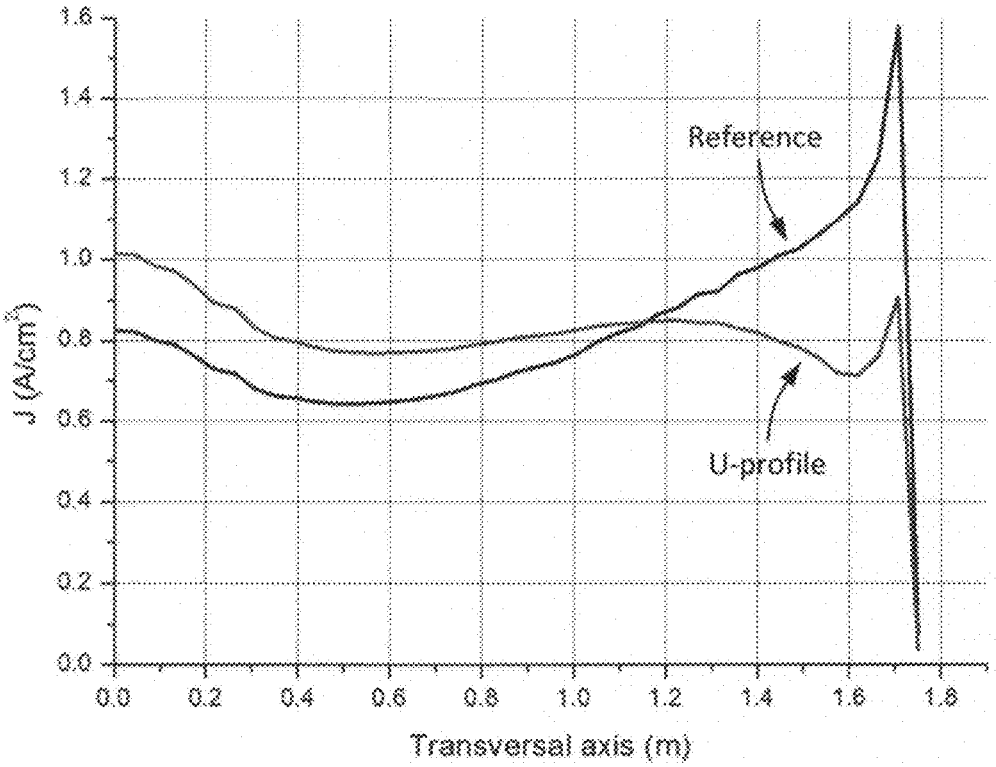
FIG. 4 is a graph of current density across a cathode equipped with a current collector according to the invention with a U-shaped profile, and a reference cathode.

FIG. 4 shows a typical impact of using the copper/metal bar on the current density at the surface of the cathode seen from the cathode center (point "0.0") to the edge of the cathode (point "1.8"). These results will be discussed later.

Figure 5A:
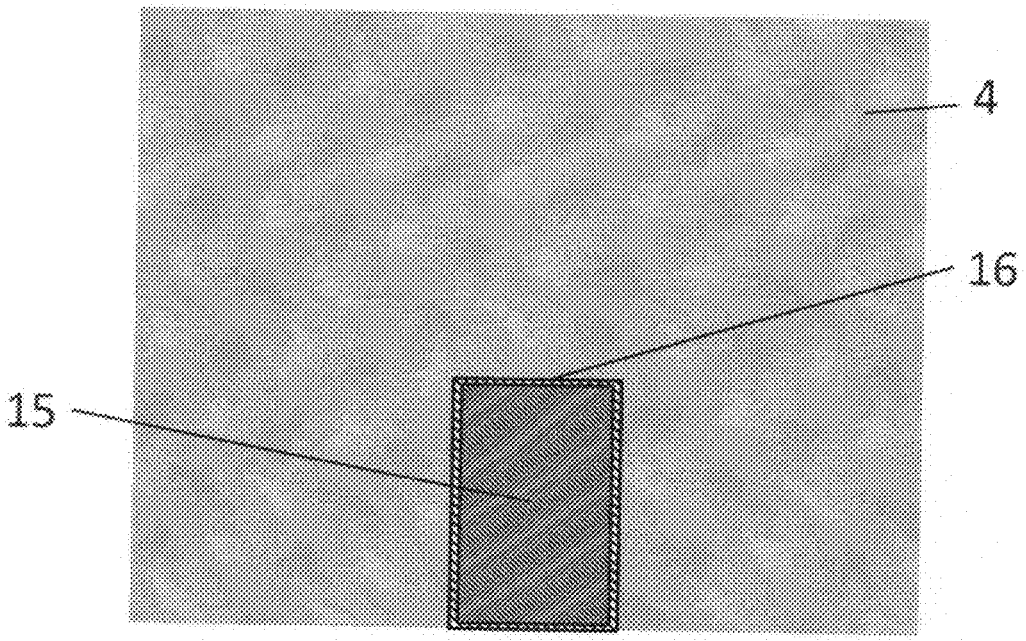
FIG. 5A is a cross section through a cathode showing the highly conductive material of the collector bar glued to a carbon cathode.

FIG. 5A shows the cathode 4 enclosing the high electrically conductive material 15 and glue 16 around the highly conductive material, this glue being electrically conductive.

Figure 5B:
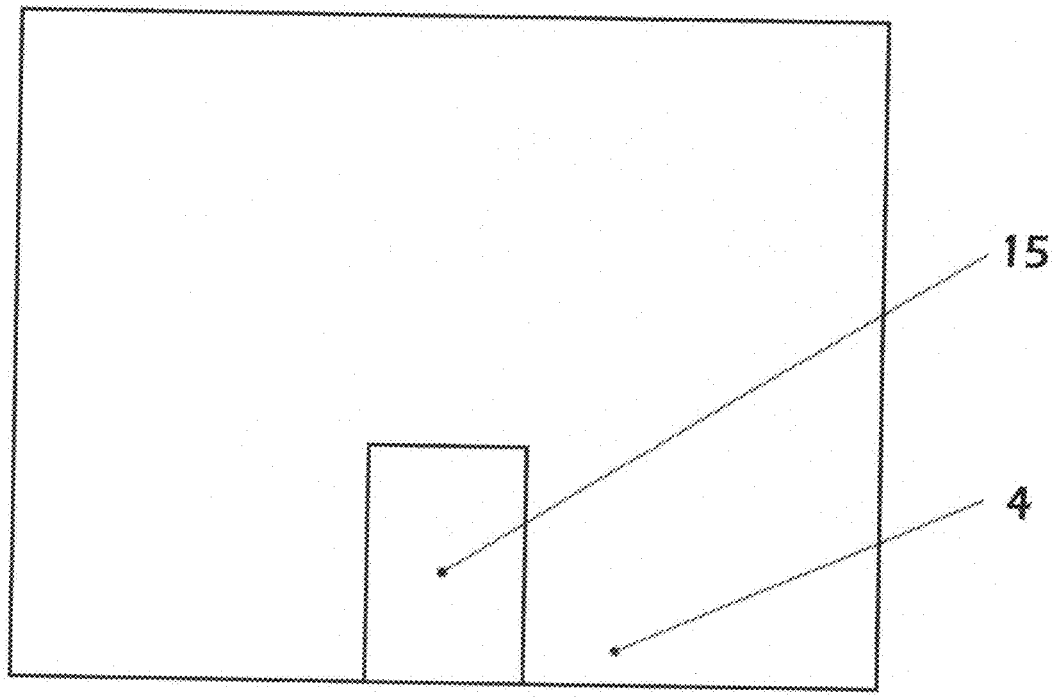
FIG. 5B is a cross section through a cathode showing the highly conductive material of the collector bar in direct electrical contact with the carbon cathode.

FIG. 5B shows the cathode 4 enclosing a bar 15 of high electrically conductive material of rectangular section in direct contact with the carbon cathode 4.

Figure 6:
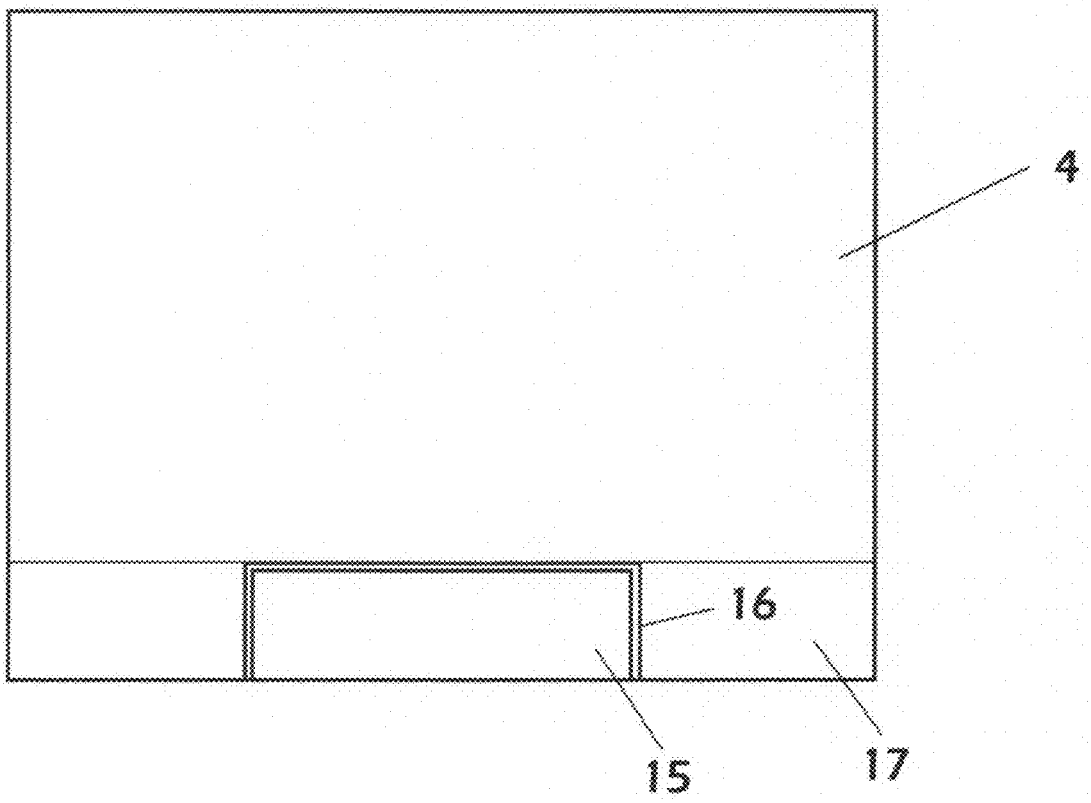
FIG. 6 is a cross section through another embodiment of a cathode current collector assembly according to the invention.

FIG. 6 shows the cathode 4, the high electrically conductive material 15 and glue 16 around the highly conductive material, and refractory bricks 17. The highly conductive material 15 is glued to the carbon cathode 4 but only on the lower part of the cathode, the sides and lower part of the cathode being replaced by refractory bricks 17 such as Schamotte or any type of electrically insulating or even electrically conductive material such as ramming paste.

Figure 7:
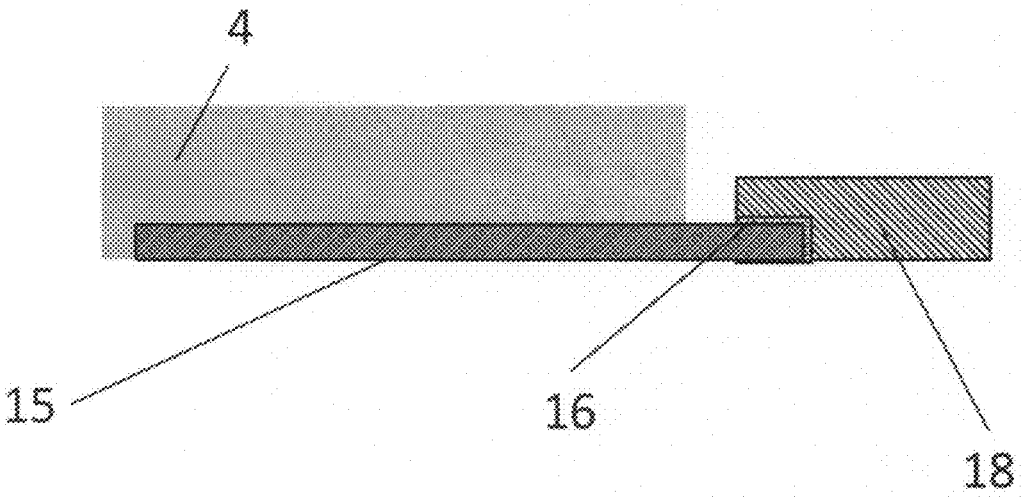
FIG. 7 illustrates how the highly conductive material of the cathode current collector bar is connected to a steel bar (transition joint) for leading the current outside the cell.

FIG. 7 shows the cathode 4, the high electrically conductive material 15 and the glue 16 around the highly conductive material and on the contacting surfaces with a transition joint formed by a steel bar 18 leading current outside the cell. The end of the collector bar can be press fitted in a machined section in the steel bar 18, in a hole, or can be glued with the same glue. Another type of connection can be the use of a steel transition joint split in two longitudinal parts that are clamped over the collector bar by a bolted connection or weld.

Figure 8:
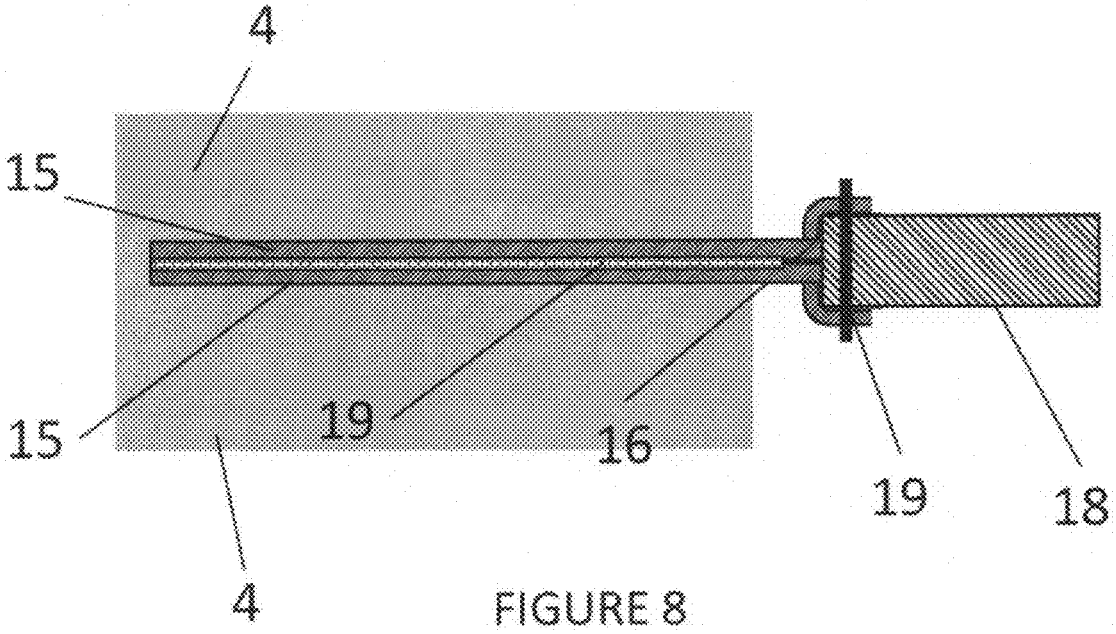
FIG. 8 shows an alternative connection of the highly conductive metal of the cathode current collector bar to a steel bar leading current outside the cell.

FIG. 8 shows the cathode 4 from the bottom, with two edge-to-edge bars of high electrically conductive material 15 separated by an expansion gap 19 and bolted to a steel bar 18 leading the current outside the cell. By using this bolted connection use is made of the two highly conductive metal elements 15 that can be spaced apart also inside the cathode to provide a thermal expansion gap inside the cathode.

Figure 9:
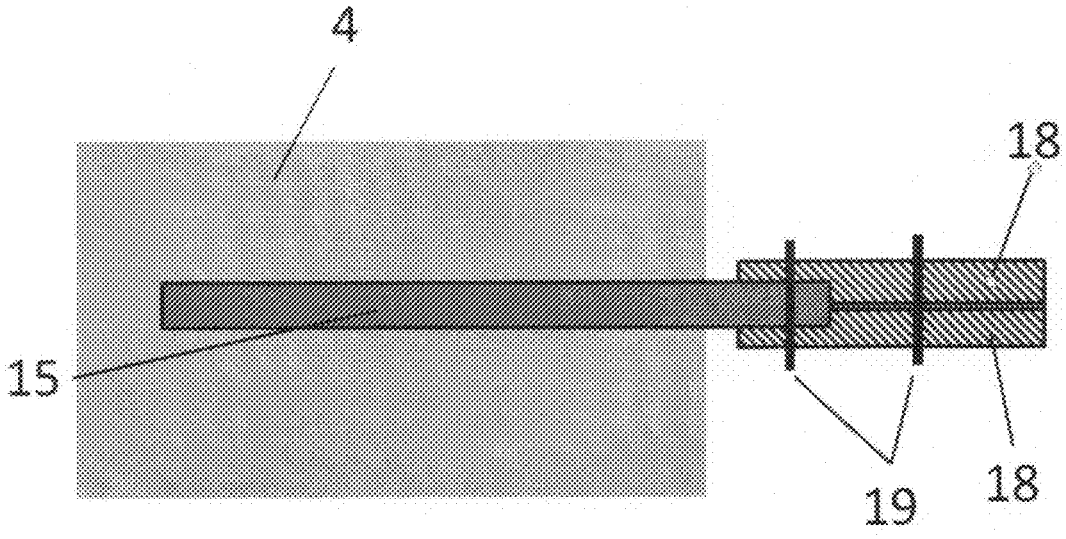
FIG. 9 shows another alternative connection of the highly conductive material of the cathode current collector bar to a steel bar leading current outside the cell.

FIG. 9 shows an alternative connection where a steel bar 18 is made of two separate elements connected together by a bolted system 19. As shown, the end of the highly electrically conductive material 15 is also secured in the end of the split steel bars 18 by the same bolted system 19.

Figure 10A:
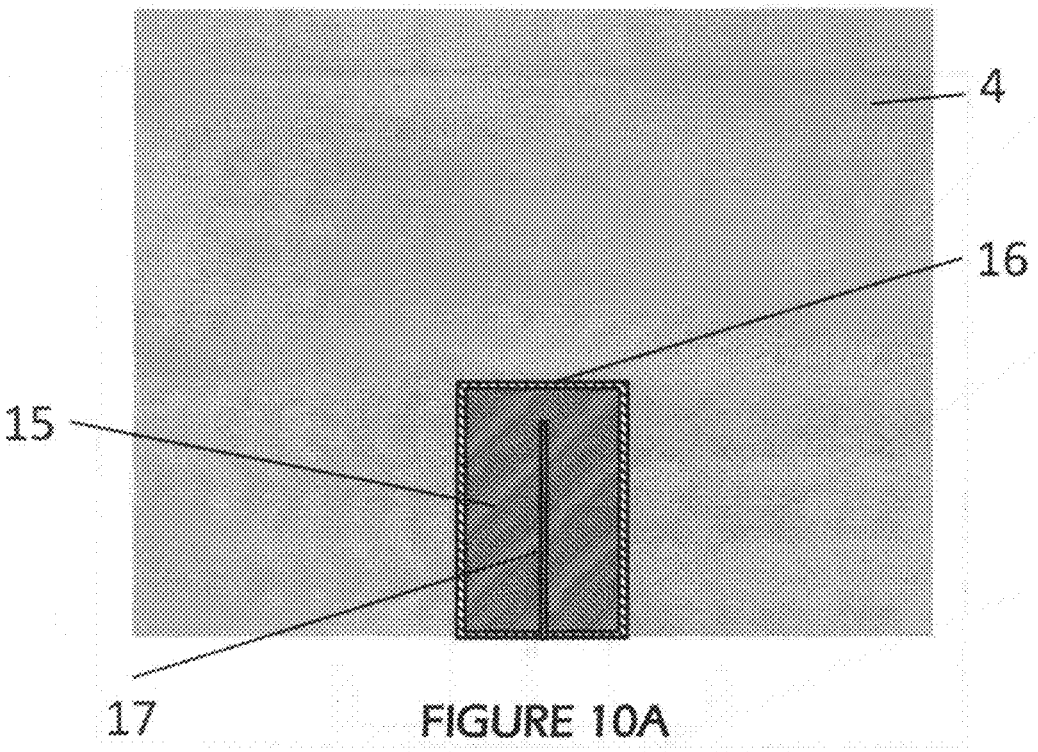
FIG. 10A shows the highly conductive material of the current collector bar machined to create a groove allowing for thermal expansion.

FIG. 10A shows the highly conductive material 15 of the current collector bar machined to create a central groove 17 extending over the main part of the height of the bar of highly conductive material, allowing for thermal expansion. In this example, the highly conductive material 15 is coated with electrically-conductive glue 16 which glues it to the cathode 4.

Figure 10B:
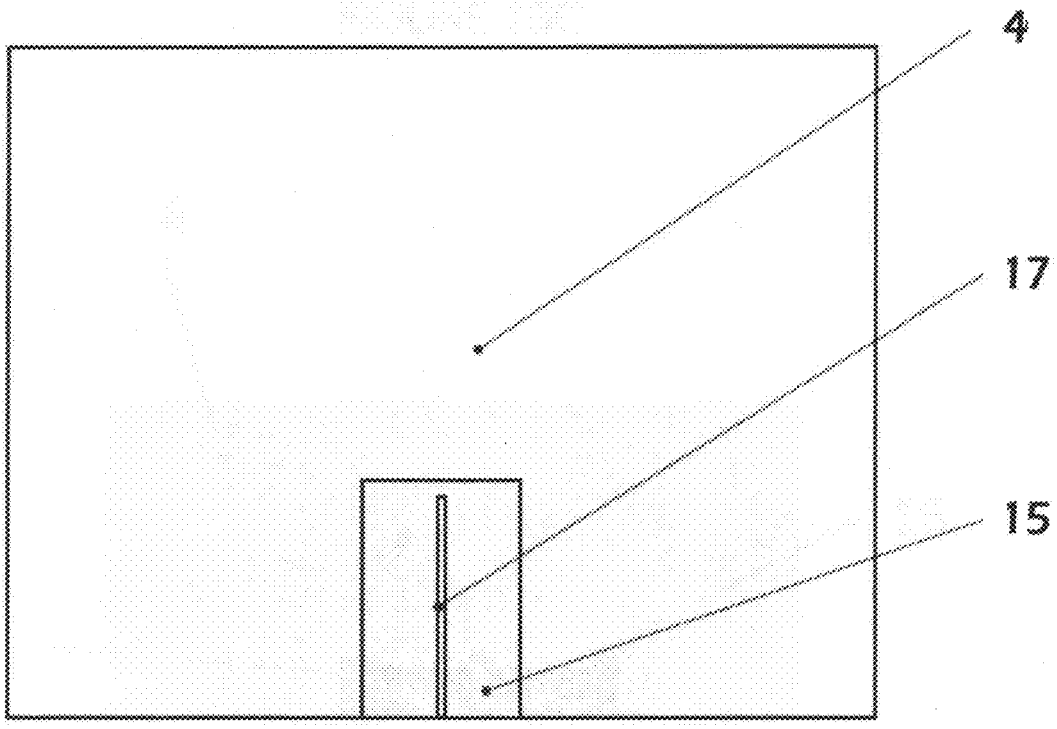
FIG. 10B shows the highly conductive material of the current collector bar machined to create a groove allowing for thermal expansion and in direct contact to a carbon cathode.

FIG. 10B shows the highly conductive material 15 of the current collector bar machined to create a central groove 17 extending over the main part of the height of the bar of highly conductive material, allowing for thermal expansion. In this example, the highly conductive material 15 is in direct contact to the carbon cathode 4. Instead of a machined groove, two or more bars of highly conductive material can be spaced from one another in spaced facing relationship.

Figure 10C:
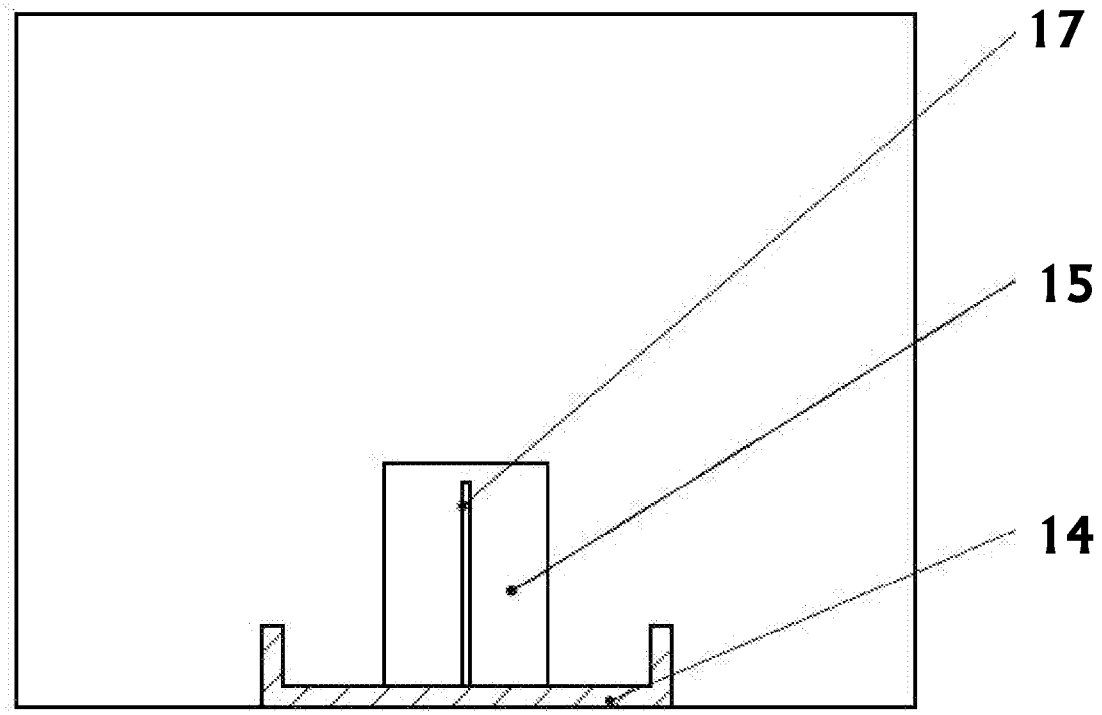
FIG. 10C shows the highly conductive material of the current collector bar, in direct contact to the carbon cathode, machined to create a slot allowing for thermal expansion and contained in a U shaped steel beam.

FIG. 10C shows the highly conductive material 15 of the current collector bar machined to create a central groove 17 extending over the main part of the height of the bar of highly conductive material allowing for thermal expansion. In this example the highly conductive material 15 is in direct contact to the carbon cathode and is supported from underneath by a U-shaped steel beam 14 wider than the highly electrically conductive material.

Figure 11:
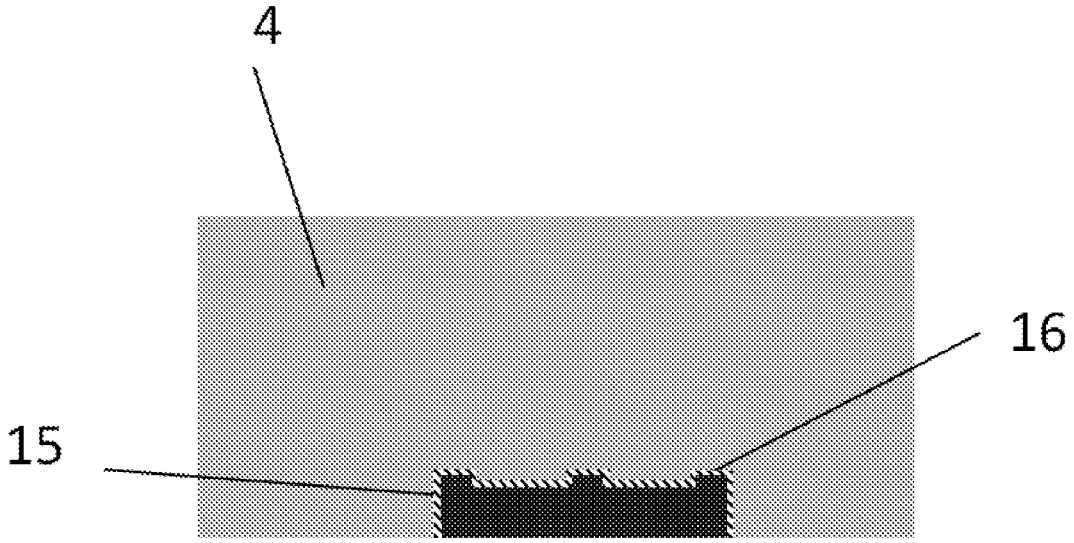
FIG. 11 shows the highly conductive material 15 shaped to increase the surface area between the cathode and the highly conductive material glued to the cathode block.

FIG. 11 shows highly conductive material 15 whose upper surface is shaped by a series of ribs or other projections to increase the surface area between the cathode 4 and the highly conductive material 15 which is glued by a layer of electrically conductive glue 16 to the cathode block 4.

Figure 12:
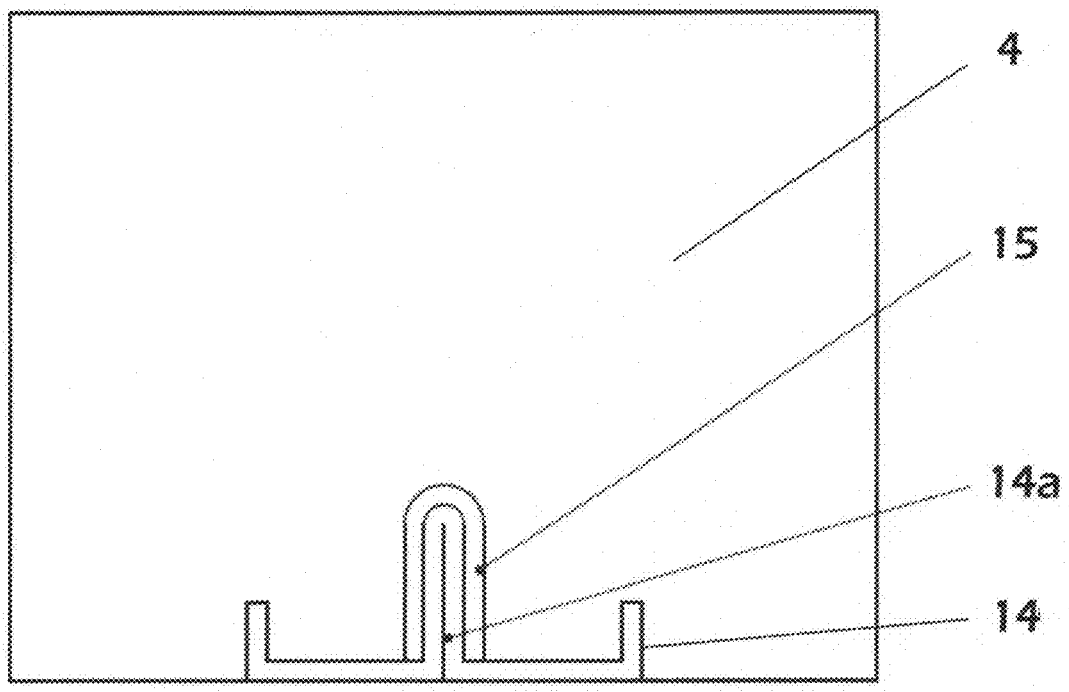
FIG. 12 shows the highly conductive material layer of the current collector bar, in direct contact to the carbon cathode with the upper side face and to a central folded fin of the U-shaped steel beam with the lower side face.

FIG. 12 shows the highly conductive material layer 15 of the current collector bar, in direct contact to the carbon cathode 4 by its upper side face and fitting over and contacting a central folded fin 14*a* of a U shaped steel beam 14 by its lower side face. There can be more than one vertical folded fin 14*a* as part of the U beam section 14.

Figure 13A:
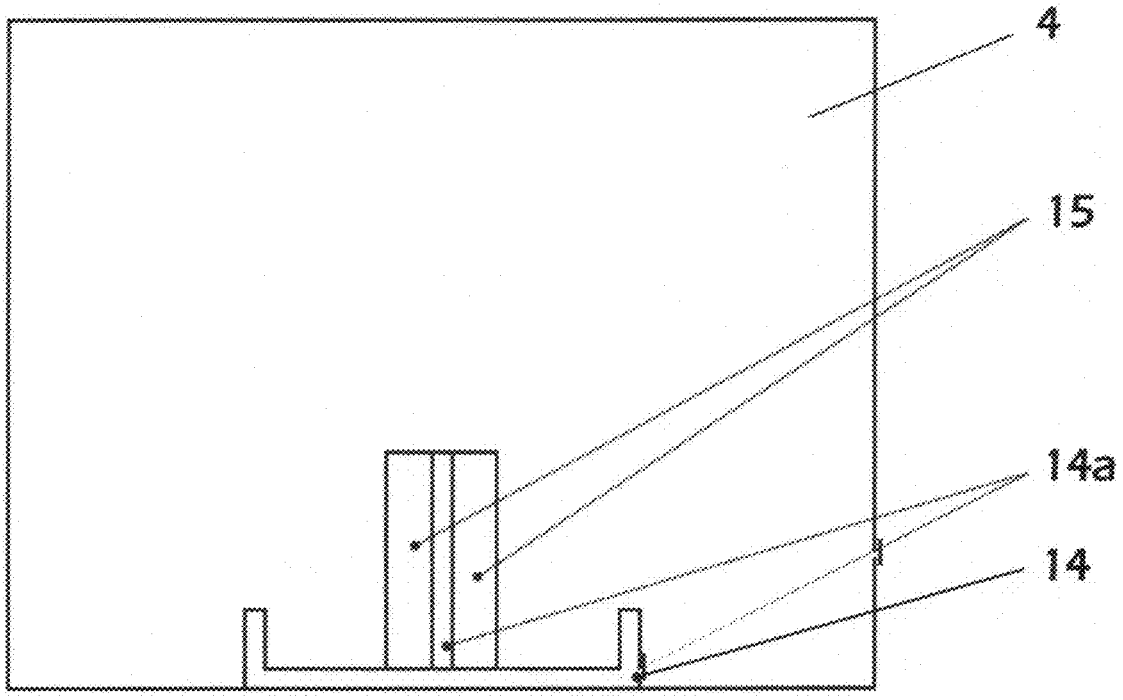
FIG. 13A shows the highly conductive material split into two separate conductive parts by a central vertical fin of a U-shaped steel beam, each conductive part being in direct contact to the carbon cathode from the upper sides and lateral faces.

FIG. 13A shows highly conductive material 15 split into two separate conductive parts by a central vertical fin 14*a* of a wide U-shaped steel beam 14, each conductive part being in direct contact to the carbon cathode 4 from its upper sides and lateral faces.

Figure 13B:
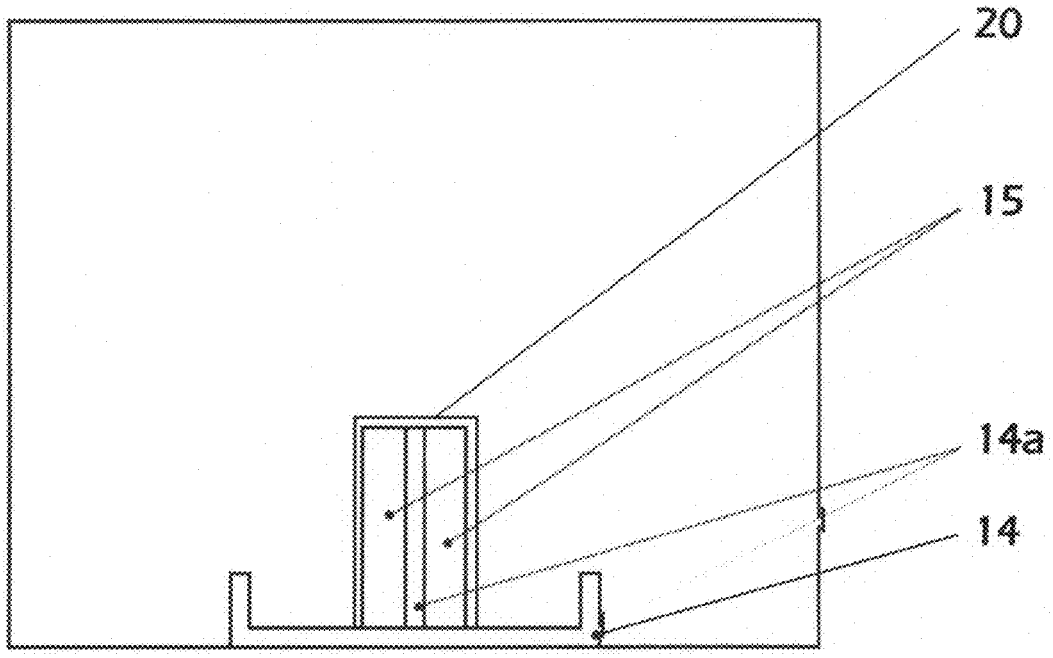
FIG. 13B shows the highly conductive material split into two separate conductive parts by a central vertical fin of a U-shaped steel beam and electrically insulated from the carbon cathode.

FIG. 13B shows the highly conductive material 15 split into two separate conductive parts by a central vertical fin 14*a* of a wide U-shaped steel beam 14, each conductive part being electrically insulated, over some segments of its length where insulation is required, namely in zone 10 (FIG. 1), from the carbon cathode 4 by a layer 20 of electrically insulating material deposited between the upper sides and the lateral faces of the conductive material and the carbon cathode 4.

Figure 13C:
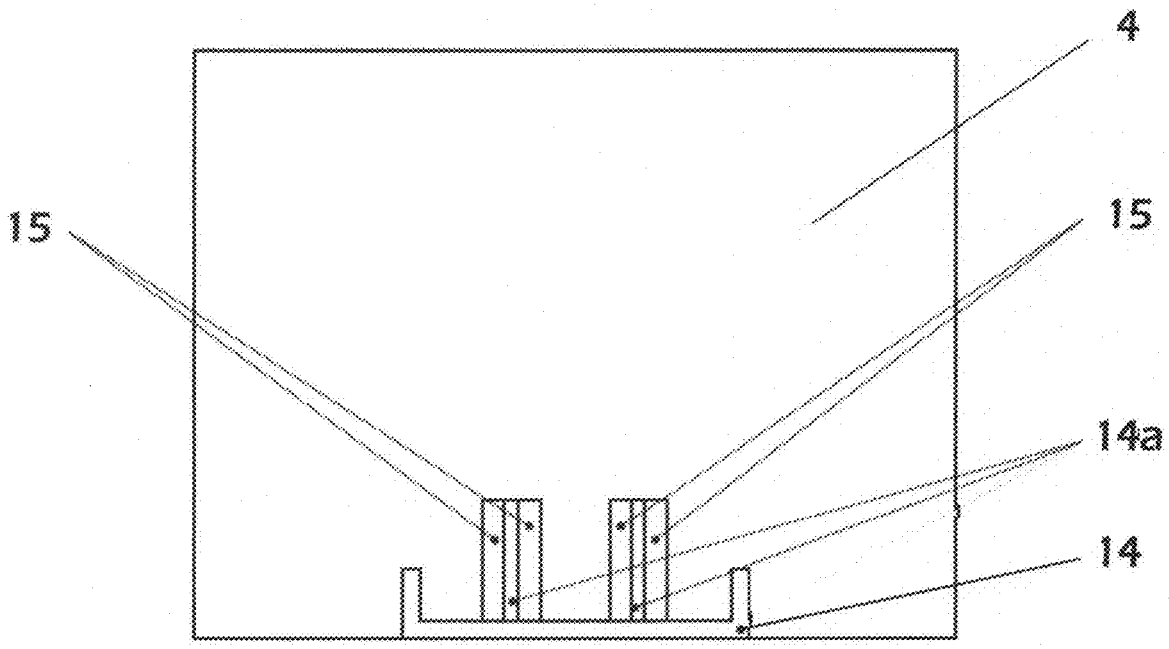
FIG. 13C shows the highly conductive material split into two separate conductive parts by each of two separate vertical fins of a U-shaped steel beam and in direct contact with the carbon cathode.

FIG. 13C shows highly conductive material 15 split into two separate conductive parts by each of two separate vertical fins 14*a* of a U-shaped steel beam 14, each conductive part being in direct contact to the carbon cathode 4 from its upper sides and lateral faces. There can be more than two vertical fins 14*a*.

Figure 14:
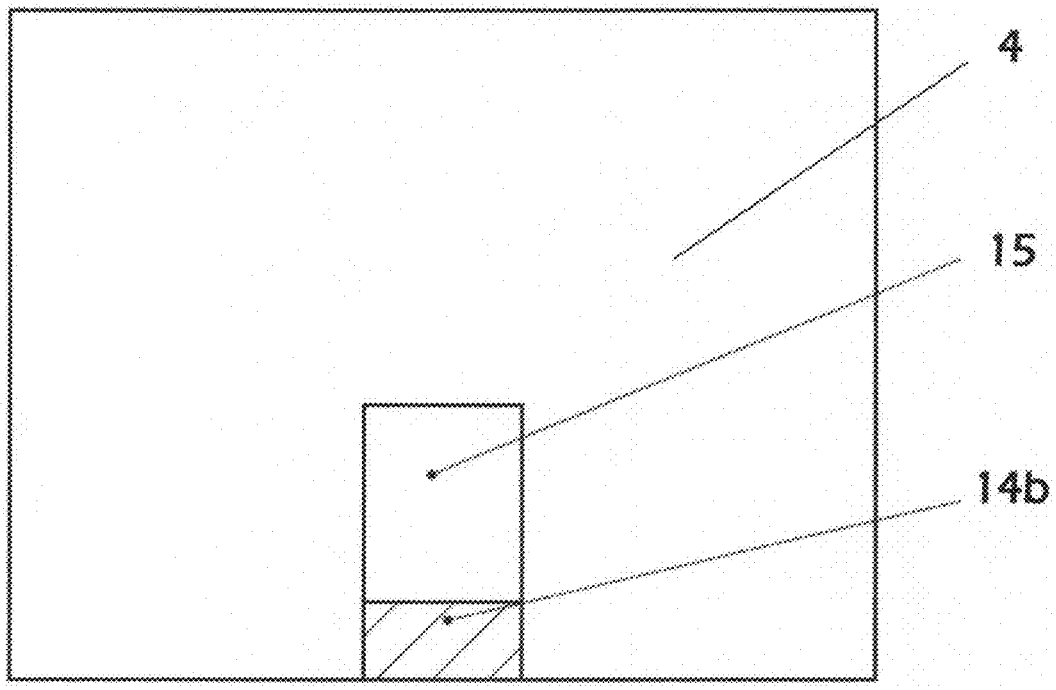
FIG. 14 shows the highly conductive material on a support, and in direct contact with a carbon cathode from the upper and lateral sides.

FIG. 14 shows a bar of highly conductive material 15 in direct contact with the carbon cathode 4 by its upper and lateral sides. The lower side of the highly conductive material 15 is supported by a "flat" steel beam 14*b* or by ramming paste or glue which is coextensive with and supports the highly conductive material 15. As described previously, the highly conductive material can be split by a groove or there can be more than one part of highly conductive material spaced apart from one another. The support beam 14*b* can be made of several layers, e.g. a steel layer over ramming paste.

Figure 15:
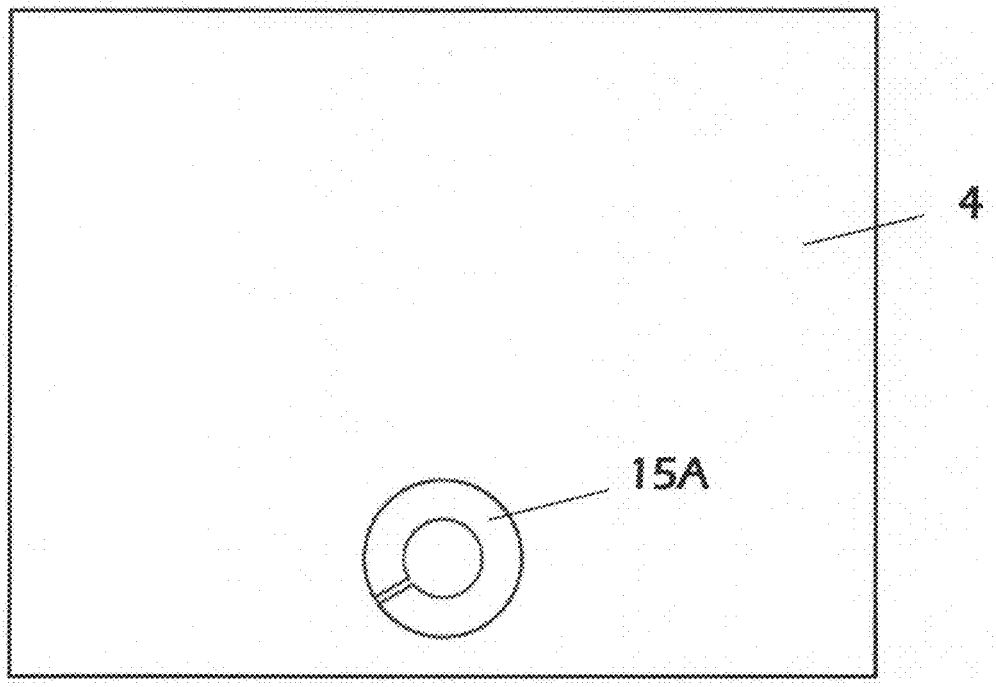
FIG. 15 shows a slotted copper tube inserted in a hole in a graphite carbon block.

FIG. 15 shows a slotted copper tube 15A inserted in a cylindrical hole in a graphite carbon block 4. The copper tube 15A is slotted along its length to provide a sufficient gap to accommodate for thermal expansion of the copper tube 15A as the cell reaches its operating temperature. The outer surface of the slotted tube 15A is preferably in direct electrical contact with the graphite of block 4.

Figure 16:
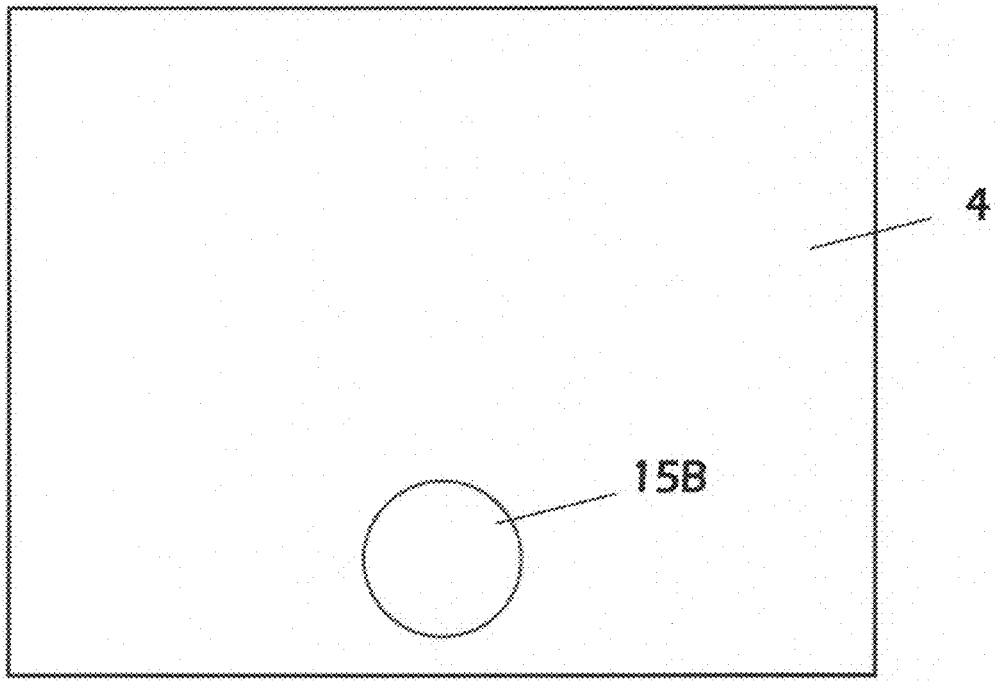
FIG. 16 shows a solid copper rod inserted in a hole in a graphite carbon block.

FIG. 16 shows a solid copper rod 15B inserted in a hole in a graphite carbon block 4. In this case, expansion allowance can be achieved by precision fitting. In other words, the diameter of the cylindrical hole in the block 4 and the diameter of the rod 15B before insertion are so calculated that the rod fits comfortably in the hole and, as the temperature of the cell rises, the rod 15B expands to fit tightly in the hole.

Figure 17:
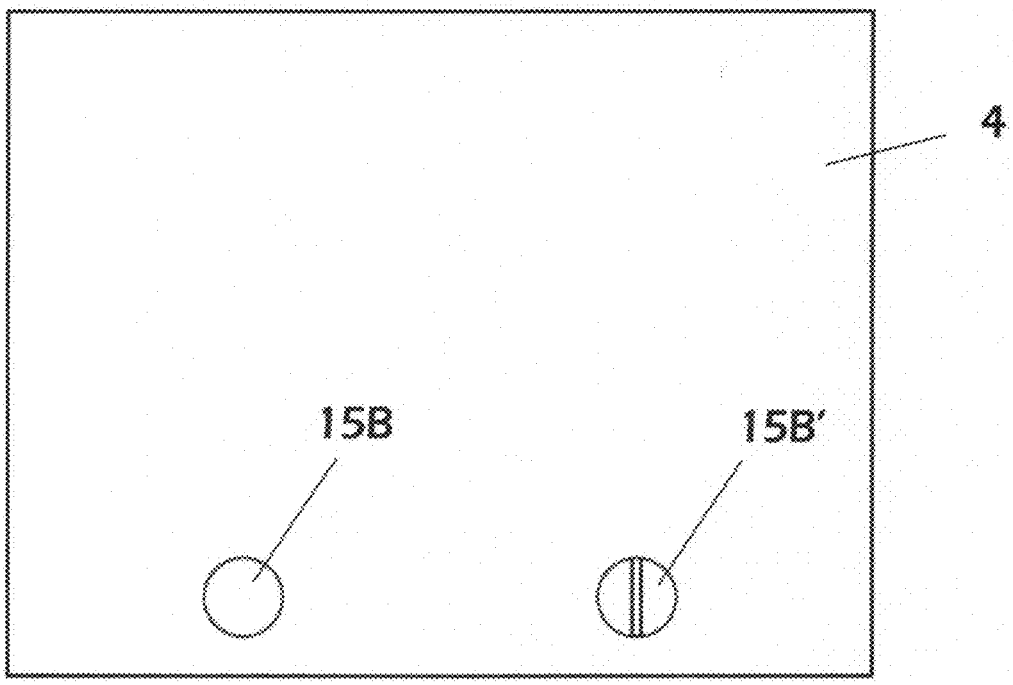
FIG. 17 shows two copper rods inserted in holes in a graphite carbon block, one rod having a gap for thermal expansion.

FIG. 17 shows two copper rods inserted in holes in a graphite carbon block 4, one rod 15B being a plain cylindrical rod as in FIG. 16 and the other rod 15B' having a diametral gap for thermal expansion.

FIGS. 15, 16 and 17 show copper bars of circular cross-section, but it is noteworthy to mention that the concept can be applied to any geometry of the hole and inserted bar/tube. The illustrated circular hole containing the copper conductor has the advantage of being sealed from underneath by the underlying carbon of the block. There is therefore no need for a supporting U-shaped beam for underneath support.

Figure 18:
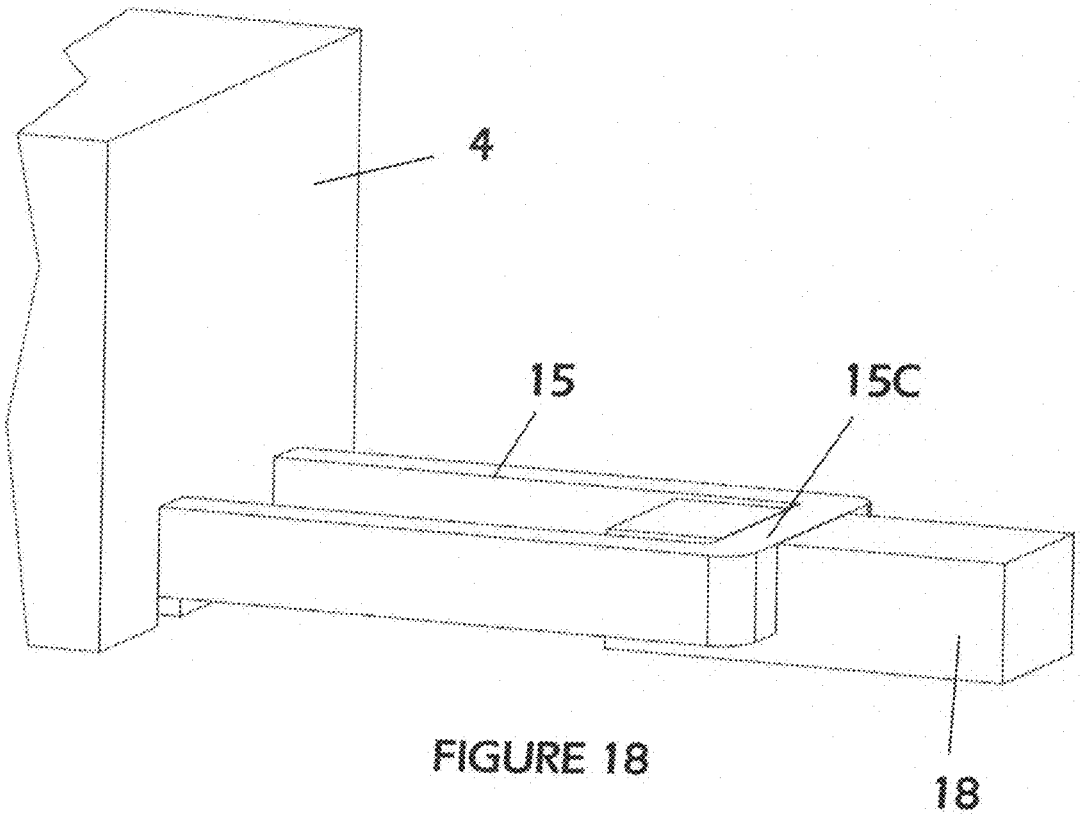
FIG. 18 is a perspective view of a copper bar bent into U-shape with two legs that are embedded in a graphite cathode block, the short section of the U-shaped copper bar being press fitted in a steel transition joint.

FIG. 18 is a perspective view of a particular embodiment for connecting the outer part of a highly conductive (copper) bar to a transition joint. As shown, a copper bar 15 is bent into U-shape with two legs that are embedded in grooves in the underside of a graphite cathode block 4 from which the two legs protrude. The short section 15C at the protruding end of the U-shaped copper bar 15 is press fitted in a transverse groove located towards the end of a steel transition joint 18. An end part of this transition joint 18 fits in between the two legs of the copper bar 15 and the transition joint 18 is deeper than the thickness of the legs of the copper bar 15. Overall, the cross-sectional area of the transition joint 18 is greater than the combined cross-sectional area of the two legs of the copper bar 15. A tight fit of the copper bar 15 with the transition joint 18 can be provided by thermal expansion of the copper in the transverse groove of the transition joint 18.

Further Description of the High Conductivity Collector Bars

The use of high conductivity collector bars can decrease the voltage drop from the liquid metal 2 and the end part of the collector bars. The copper or other high conductive material 15 with or without a U-shaped profile 14 or support beam 14*b* also helps to decrease the anode to cathode distance (ACD) allowing a decrease of the specific energy consumption, and an increase in the height of the cathode leading to increased cell lifetime.

The lengths L1, L2 and L3 (FIG. 1) are optimized in function of the busbar system and of the cell geometry in order to optimize the cell stability. Indeed, the redistribution of the current through the collector bars allows for a much better magneto-hydrodynamic cell state that will allow decreasing the ACD while increasing the current and hence minimizing the energy consumption. This is reflected by a homogeneous vertical current density in a horizontal section in the middle of the liquid metal pool.

A typical example of current density is shown in FIG. 4 for a standard cell and for a cell according to the invention in FIG. 3 or FIG. 5A. The vertical current density (Jz) depends on the location in the liquid metal, ie. Jz=Jz(x,y,z) in a (x,y,z) coordinate system. When moving from the edge of the external part of the shadow of one anode ($x=-X_L$) to the edge of the shadow of the neighboring anode ($x=X_L$) in an horizontal plane inside the liquid metal, the absolute value of the vertical component of the current density (|Jz(x)|) varies typically as shown in FIG. 4. When optimizing the collector bars by using a high conductivity metal 15, such as copper in direct electrical contact with the graphite cathode, contained in a U-shaped profile 14 or directly fitted into a cathode slot, |Jz(x)| is reduced by a minimum of 50% as shown in FIG. 4 (right hand part). The section of the collector bar is such that the heat extraction is minimum from the side of the carbon cathode to the end of the collector bar. In fact it is dimensioned in such a way as to obtain a temperature drop of around 200° C. outside, and a voltage drop as low as possible.

The invention claimed is:

1. A cathode current collector assembly assembled in a carbon cathode of a Hall-Héroult cell for the production of aluminium, the cathode current collector assembly comprising at least one collector bar of a highly electrically conductive metal that is located under the carbon cathode, the highly-electrically conductive metal having an electrical conductivity greater than that of steel, characterized in that the at least one collector bar consists of the highly-electrically conductive metal as a single solid body consisting of the highly-electrically conductive metal; or as two solid bodies spaced apart from one another and separated by a thermal expansion gap, each solid body consisting of the highly electrically-conductive metal; or said at least collector bar consists of a solid body consisting of the highly-electrically conductive metal mounted on a U-shaped profile made of a material that retains its strength at the temperatures in a Hall-Héroult cell cathode, said U-shaped profile being composed of a thin wall including a bottom under said at least one collector bar on which said at least one collector bar formed by said solid body rests and side sections that extend on the sides and are spaced apart from or contact lateral sides of said at least one collector bar formed by said solid body consisting of the highly-electrically conductive metal, said at least one collector bar consisting of the highly electrically conductive metal having at least an upper part left free by the U-shaped profile to enable the highly electrically conductive metal to contact the carbon cathode directly or via a conductive interface;

the at least one collector bar consisting of highly electrically conductive metal comprises a central part located under a central part of the carbon cathode, said central part of the at least one collector bar consisting of a highly electrically conductive metal having at least an upper outer surface of the highly conductive metal constituting the at least one collector bar in direct electrical contact with the carbon cathode or in contact with the carbon cathode through an electrically conductive interface formed by an electrically conductive glue applied over and in direct contact with the surface of the at least one collector bar consisting of a highly electrically conductive metal and/or by an electrically conductive flexible foil or flexible sheet, said flexible foil or flexible sheet being made of a metal cloth, mesh or foam of copper, a copper alloy, nickel or a nickel alloy, or a graphite foil or fabric, or a combination thereof that is applied over the surface of the at least one collector bar consisting of a highly electrically conductive metal;

the at least one collector bar consisting of a highly electrically conductive metal comprises one outer part or two outer parts located adjacent to and respectively on one side or on either side of said central part and a terminal end part or two terminal end parts extending outwardly respectively from the one or two outer parts, said terminal end part or parts and only said terminal end part or parts of the at least one collector bar that consists of a highly electrically conductive metal is/are directly physically attached each to an external steel conductor bar of greater cross-sectional area than the at least one collector bar consisting of a highly electrically conductive metal so as to electrically connect in series the highly-electrically conductive metal constituting the collector bar and the external steel conductor bar, each said external steel conductor bar extending outwardly from the terminal end part or parts of the at least one collector bar consisting of a highly electrically conductive metal, for connection to an external current supply;

each terminal end part of the at least one collector bar consisting of a highly electrically conductive metal physically attached to the external steel conductor bar forms a transition joint wherein the at least one collector bar consisting of a highly electrically conductive metal and the external steel conductor bar overlap one another partially only in the region of said terminal end part or parts of said at least one collector bar and are secured together by welding, by electrically-conductive glue and/or by a clamp or other means for applying a mechanical pressure or a joint secured by thermal expansion, or by a threaded connection, and in the case where said at least one collector bar that consists of a solid body consisting of the highly-electrically conductive metal is supported on a said thin-walled U-shaped profile made of a material that retains its strength at the temperatures in a Hall-Héroult cell cathode, said U-shaped profile supports the at least one collector bar in its said central part without the U-shaped profile and the material forming the U-shaped profile extending beyond said central part, and the U-shaped profile has side walls that do not extend above the at least one collector bar.

2. The cathode current collector assembly according to claim 1, wherein the highly electrically conductive metal is selected from copper, aluminium, silver and alloys thereof.

3. The cathode current collector assembly according to claim 1, wherein the surface of the highly electrically conductive metal that interfaces with the carbon cathode is roughened or provided with recesses or projections to enhance contact area with the carbon cathode.

4. The cathode current collector assembly according to claim 1, comprising a said conductive interface between the highly electrically conductive metal and the carbon cathode.

5. The cathode current collector assembly according to claim 4, wherein said conductive glue comprises a carbon-based electrically conductive glue obtainable by mixing a solid carbon-containing component with a liquid component of a 2-component hardenable glue.

6. The cathode current collector assembly according to claim 1, wherein the at least one collector bar consisting of a highly electrically conductive metal has sides comprising the lateral sides when the at least one collector bar comprises the u-shaped profile and a bottom and wherein the sides or the sides and the bottom of the at least one collector bar consisting of a highly electrically conducive metal directly or indirectly contact ramming paste or refractory bricks in contract with the carbon cathode.

7. The cathode current collector assembly according to claim 1, wherein the at least one collector bar consisting of a highly electrically conductive metal comprises at least one slot arranged to compensate for thermal expansion of the bar in the cathode by allowing inward expansion of the highly electrically conductive metal into the space provided by the slot or slots or wherein two or more of said collector bars consisting of a highly electrically conductive metal are spaced apart from one another to allow compensation for thermal expansion.

8. The cathode current collector assembly according to claim 1, wherein the carbon cathode electrically contacts an open upper outer surface of the highly electrically conductive metal as a result of the weight of the carbon cathode on the highly electrically conductive metal, and thermal expansion of the highly electrically conductive metal.

9. The cathode current collector assembly according to claim 1, wherein said outer part or parts of the at least one collector bar consisting of a highly electrically conductive metal extend under or through an electrically conductive part of the cell bottom, said outer part or parts of the at least one collector bar consisting of a highly electrically conductive metal being electrically insulated from the electrically conductive part of the cell bottom.

10. The cathode current collector assembly according to claim 9, wherein said outer part or parts of the at least one collector bar consisting of a highly electrically conductive metal is/are insulated from the electrically conductive part of the cell bottom by being encased in an insulator, namely by being encased in one or more sheets of alumina or other insulating material wrapped around said outer part or parts or a layer of electrically insulating glue or cement.

11. The cathode current collector assembly according to claim 1, wherein said central part of the at least one collector bar consisting of a highly electrically conductive metal is held in a said U-shaped profile made of a material that retains its strength at the temperatures in a Hall-Héroult cell cathode, the U-shaped profile being composed of a thin wall having a bottom under said collector bar and on which the collector bar rests, and side sections that extend on and are spaced apart from or contact sides of the at least one collector bar consisting of a highly electrically conductive metal, said at least one collector bar consisting of a highly electrically conductive metal having at least an upper part left free by the U-shaped profile to enable the highly electrically conductive metal to contact the carbon cathode directly or via a said conductive interface.

12. The cathode current collector assembly according to claim 1, wherein said U-shaped profile is made of steel, or of concrete or a ceramic.

13. The cathode current collector assembly according to claim 1, wherein the at least one collector bar is a solid single body consisting of a highly electrically conductive metal that is contained at least in the central part of the cathode in a through-hole in the carbon cathode, the through-hole having an inwardly-facing surface, whereby the at least one collector bar consisting of a highly electrically conductive metal is mounted on and is supported on an underlying part of the carbon cathode and is surrounded by and in electrical contact with the inwardly-facing surface of the through-hole in the carbon cathode.

* * * * *